US012385120B2

(12) United States Patent
Evans et al.

(10) Patent No.: US 12,385,120 B2
(45) Date of Patent: Aug. 12, 2025

(54) SLURRY-BLASTED HOT-ROLL-BASED HOT DIP ALUMINIZED STEEL STRIP

(71) Applicant: Cleveland-Cliffs Steel Properties Inc., West Chester, OH (US)

(72) Inventors: James F. Evans, Middletown, OH (US); Andrew Miller, Cincinnati, OH (US)

(73) Assignee: Cleveland-Cliffs Steel Properties Inc.

( * ) Notice: Subject to any disclaimer, the term of this patent is extended or adjusted under 35 U.S.C. 154(b) by 0 days.

(21) Appl. No.: 18/127,840

(22) Filed: Mar. 29, 2023

(65) Prior Publication Data

US 2023/0323520 A1 Oct. 12, 2023

Related U.S. Application Data

(60) Provisional application No. 63/329,084, filed on Apr. 8, 2022.

(51) Int. Cl.

| | |
|---|---|
| ***C23C 2/12*** | (2006.01) |
| ***C21D 7/13*** | (2006.01) |
| ***C23C 2/02*** | (2006.01) |
| ***C23C 2/40*** | (2006.01) |

(52) U.S. Cl.

CPC ..... *C23C 2/024* (2022.08); *C21D 7/13* (2013.01); *C23C 2/12* (2013.01); *C23C 2/40* (2013.01)

(58) Field of Classification Search

CPC .. C23C 2/024; C23C 2/12; C23C 2/40; C21D 7/13; B24C 1/00

See application file for complete search history.

(56) References Cited

U.S. PATENT DOCUMENTS

| | | | | |
|---|---|---|---|---|
| 4,729,929 | A * | 3/1988 | Shinoda | C23C 2/12 428/653 |
| 2008/0108281 | A1 | 5/2008 | Voges et al. | |
| 2016/0008950 | A1 * | 1/2016 | Quan | B21B 45/08 451/75 |

FOREIGN PATENT DOCUMENTS

| | | | |
|---|---|---|---|
| WO | 2014/146540 | A1 | 9/2014 |
| WO | 2022/029033 | A1 | 2/2022 |

OTHER PUBLICATIONS

International Search Report and Written Opinion dated Jun. 14, 2023 for Application No. PCT/US2023/016722, 11 pages.

* cited by examiner

*Primary Examiner* — Hai Y Zhang
(74) *Attorney, Agent, or Firm* — Frost Brown Todd LLP

(57) ABSTRACT

Preparing a coated steel including the steps of hot rolling or cold rolling, slurry blasting, and coating. The step of hot rolling or cold rolling including rolling a steel ingot to form a steel strip. The step of slurry blasting including slurry blasting at least one side of the steel strip. The step of coating being performed after slurry blasting and including coating the steel strip with an aluminum-based coating.

7 Claims, 5 Drawing Sheets

SLURRY-BLASTED HOT-ROLL-BASED HOT DIP ALUMINIZED STEEL STRIP

PRIORITY

This application claims priority to U.S. Provisional Application Ser. No. 63/329,084, entitled Slurry-Blasted Hot-Roll-Based Hot Dip Aluminized Steel Strip, filed on Apr. 8, 2022, the disclosure of which is incorporated by reference herein.

BACKGROUND

The present invention pertains to aluminized carbon steels. Aluminizing may be performed to a steel to coat one or more surfaces of the steel with an aluminum-based coating. Such aluminum-based coatings may be alloyed with other constituents in some circumstances. For instance, in Type-1 aluminized coatings, aluminum may be alloyed with silicon. Such alloying may be desirable to enhance certain mechanical properties of the coating. In other circumstances, commercially pure aluminum may be used without alloying. Such commercially pure aluminized coatings may be referred to as Type-2 aluminized coatings.

In some circumstances, an aluminized coating of either Type-1 or Type-2 with high adherence may be desirable. Although many factors can contribute to improved adherence, surface preparation of the steel substrate is one factor that may contribute. With hot-rolled steels or cold rolled steels, scale may build up on the surface of the steel during hot-rolling or cold-rolling. The presence of scale on the surface of the steel substate may be generally undesirable during aluminizing because such scale may introduce contaminants into the steel-aluminum interface, thereby preventing complete adhesion. It may accordingly be desirable to eliminate scale from the surface of either hot-rolled or cold-rolled steel prior to aluminizing.

One method of scale removal that may be used can include pickling, where chemical agents are used to consume scale on the surface of the steel substrate. In some contexts, pickling may be combined with other mechanical scale removal processes such as peening, grinding, and/or etc. Although these processes are relatively efficient at removing scale, they have a greater propensity to create an uneven or non-uniform surface preparation. It may therefore be desirable to eliminate scale removal processes such as pickling and/or mechanical scale removal for other processes that provide a more uniform and/or even surface preparation with efficiencies comparable to pickling and/or mechanical scale removal processes.

DETAILED DESCRIPTION

Figure 1:
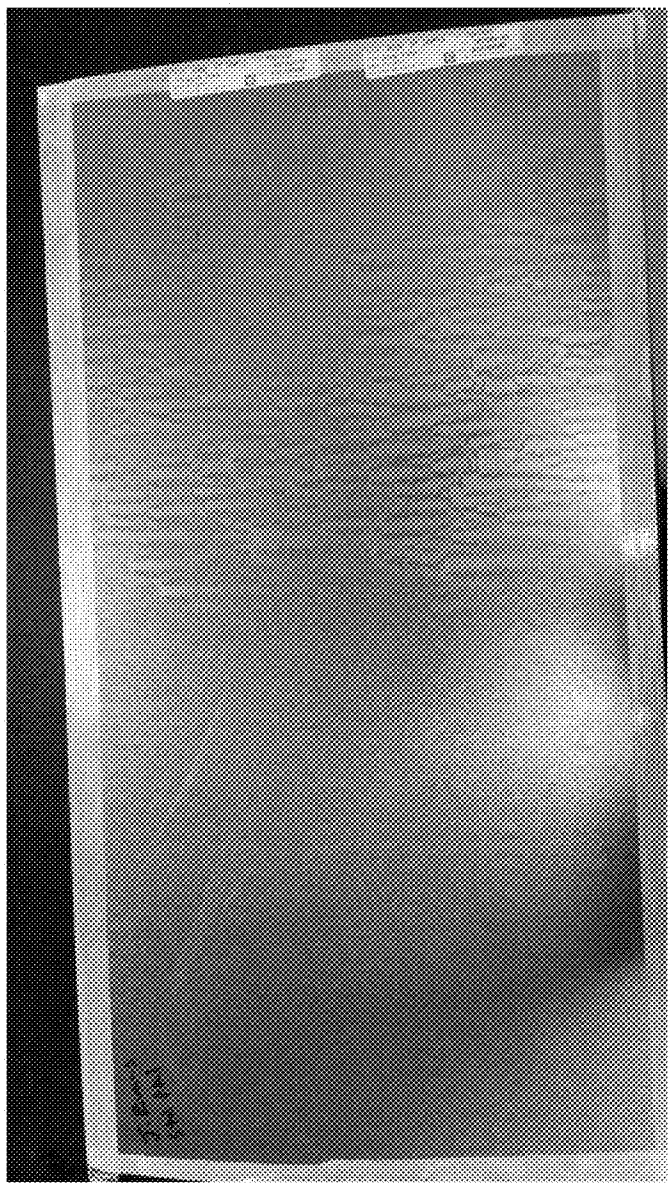
FIG. 1 depicts the surface appearance of an aluminized coating on a first sample, the first sample subjected to pickling prior to aluminizing.

The present invention pertains to aluminized steels. Aluminized steels may be desirable to provide corrosion resistance comparable to stainless steel at a lower cost. Additionally, aluminized steels may exhibit the property of heat reflectivity. Thus, aluminized steels may be desirable in service environments where corrosion and/or high heat may be present.

Aluminized coatings may be referred to as Type-1 and Type-2 aluminized coatings. In Type-1 aluminized coatings, aluminum may be alloyed with silicon to form an aluminum-silicon alloy on one or more surfaces of the steel. Such aluminum-silicon alloys in Type-1 aluminized coatings may include about 5 to 11% silicon and a balance of aluminum and impurities. The presence of silicon may control the formation of an intermetallic layer between the steel substrate and the coating during a hot-dip coating process. For instance, the presence of silicon may contribute to slowing the growth of the intermetallic layer during the hot-dip coating process. In the as-coated condition, the restricted growth of the intermetallic layer may be desirable to improve heat resistance of the aluminized coating. Type-1 aluminized coatings may therefore be desirable in contexts where heat resistance is desirable.

Type-2 aluminized coatings, by contrast, include commercially pure aluminum without additional alloying elements. Without the presence of additional alloying elements, the formation of the intermetallic layer may be less controlled during the hot-dip coating process relative to Type-1 aluminized coatings. However, without the presence of additional alloying elements, the aluminized coating may be more resistant to corrosion relative to Type-1 aluminized coatings. Type-2 aluminized coatings may therefore be desirable in contexts where corrosion resistance is prioritized over heat resistance. It should be understood that aspects of the present disclosure relate to either Type-1 or Type-2 aluminized coatings. The principles described herein can accordingly be applicable to both Type-1 and Type-2 aluminized coatings, even when aluminizing processes are referred to generally without any particular reference to Type-1 or Type-2 aluminized coatings.

The processes of hot-rolling or cold-rolling may lead to the build up of scale on the surface of the hot-rolled or cold-rolled steel strips. The presence of scale on the surface of the hot-rolled or cold-rolled steel strips prior to aluminizing is generally undesirable because the presence of scale can introduce contamination into the coating itself and/or the intermetallic layer between the steel substate and the aluminized coating. As a result of such contaminants, the strength of adhesion between the steel substrate and the aluminized coating may be degraded, which may result in uneven, splotchy, or otherwise poor surface quality of the aluminized coating.

Some processes for removing scale may include pickling and or mechanical removal process. Pickling in particular, may be desirable as the process can be performed efficiently and continuously in-line after hot-rolling or cold-rolling and prior to coiling of the steel strip. However, due to variations in operating conditions of the pickling process, the surface of the pickled steel strip may be uneven or inconsistent, despite effectively removing scale. Such uneven or inconsistent surface preparation may be observed anywhere in the steel strip once coiled, although concentration at the extremities of the coil has been observed.

Once the steel strip is subjected to hot-dip aluminizing, such unevenness or inconsistencies in the surface of the steel strip may lead to an uneven or splotchy aluminized coating. This uneven or splotchy aluminized coating may be the result of poor wetting characteristics of the surface of the steel strip during hot-dip aluminizing. Accordingly, certain processes may be desirable to improve the surface preparation of a hot-rolled or cold-rolled steel strip prior to hot-dip aluminizing.

Aspects of the present disclosure relate to the use of slurry blasting to prepare one or more surfaces of a hot-rolled or cold-rolled steel strip for hot-dip aluminizing. Slurry blasting is a process that involves mixing abrasive agents with pressurized fluid (e.g., water) and then directing the mixture at high velocities towards a surface. Slurry blasting was previously not used with hot-dip aluminizing due to challenges associated with the costs and time requirements associated with moving whole steel coils for conducting trials. In the present version, slurry blasting may be performed to the hot-rolled or cold-rolled steel strip at one or more points during the steel production process. For instance, as will be described in greater detail below, slurry blasting may be performed immediately after hot-rolling or cold-rolling and prior to coiling. Alternatively, slurry blasting may be performed independently after coiling but still prior to hot-dip aluminizing. In both instances, slurry blasting may be performed in connection with either Type-1 or Type-2 aluminizing. Alternatively, in some versions, slurry blasting may be performed in connection with other forms of coatings such as galvanized or zinc-based coatings.

In a first aspect of the present disclosure, slurry blasting is performed in a multi-step process. In the multi-step process, a coil of hot-rolled steel strip (or alternatively cold-rolled steel strip) may be unwound from a wound configuration to a longitudinally unwound configuration. The steel strip in the unwound configuration may then be subjected to slurry blasting. During the step of slurry blasting, scale may be removed from one or more surfaces of the steel strip. Control of the slurry blasting process may be performed in real-time by an operator. Specifically, the operator may adjust operational parameters such as feed speed and pressure in real-time to achieve sufficient removal of scale from one or more surfaces of the steel strip.

After the step of slurry blasting is complete, the steel strip may be dried and recoiled. The recoiled steel strip may then be transferred to a hot-dip aluminizing line, where the recoiled still strip may again be uncoiled and subjected to heat-to-coat hot-dip aluminizing using molten aluminum having Type-1 or Type-2 characteristics.

In some versions of the first aspect of the present disclosure, the slurry blasting process may be performed continuously. For instance, unrolling of the steel strip may occur at one end of a line, while rolling may occur at an opposite end of the line. The step of slurry blasting may then be performed between the unrolling and rolling ends of the line. In this configuration, the steel strip may be slurry blasted continuously as the coil is unrolled and rerolled simultaneously.

In a second aspect of the present disclosure, slurry blasting is performed in an integrated (or single step) process. In the integrated process, the step of slurry blasting may be combined with the step of hot-dip aluminizing. Specifically, the steel strip may be transferred to a hot-dip aluminizing line after hot-rolling (or alternatively cold-rolling). Optionally, in some versions, pickling or other scale removal may be performed in connection with hot-rolling. Although in other versions, other forms of scale removal, including pickling, may be omitted entirely.

Once the coiled steel strip is transferred to the hot-dip aluminizing line, the coil may be unwound and enter the hot-dip aluminizing line. Slurry blasting may then be performed as a part of the pre-cleaning process used in the hot-dip aluminizing line. The step of slurry blasting may be performed to remove scale from one or more surfaces of the steel strip. Control of the slurry blasting process may be performed in real-time by an operator. Specifically, the operator may adjust operational parameters such as feed speed and pressure in real-time to achieve sufficient removal of scale from one or more surfaces of the steel strip.

After the step of slurry blasting, the steel strip may be fed further into the hot-dip aluminizing line for reheating of the steel strip followed by immersion of the steel strip into the hot-dip aluminizing bath using molten aluminum having Type-1 or Type-2 characteristics. Once aluminizing is complete, the coated steel strip may be recoiled.

Example 1

Samples were prepared of a hot-rolled steel strip coil. The hot-rolled steel strip coil was subjected to pickling. After pickling, the steel strip was subjected to heat-to-coat hot-dip aluminizing and subsequent recoiling. In the present example, heat-to-coat hot-dip aluminizing refers to an aluminizing process where the steel strip was first heated to about the temperature of the molten aluminum bath and then the steel strip was immersed in the molten aluminum bath.

Figure 2:
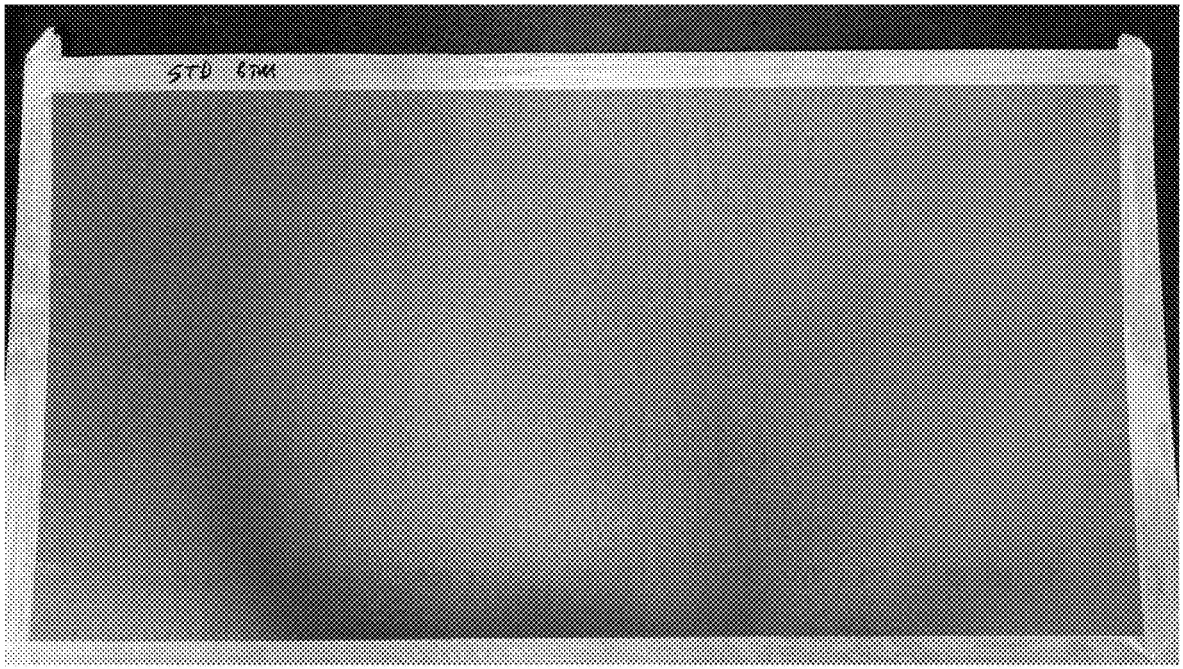
FIG. 2 depicts the surface appearance of an aluminized coating on a second sample, the second sample subjected to pickling prior to aluminizing.

FIGS. 1 and 2 show the surface of the resulting aluminized coating after pickling was used prior to aluminizing. Specifically, FIG. 1 shows a first sample where the surface of the aluminized coating is relatively non-uniform, particularly in the region towards the left of the page. Similarly, FIG. 2 shows a second sample where the surface of the aluminized coating is also relatively non-uniform, particularly in the region towards the right of the page.

Example 2

Additional samples were prepared of a hot-rolled steel strip coil. The hot-rolled steel strip coil was subjected to slurry blasting. After slurry blasting, the steel strip was subjected to heat-to-coat hot-dip aluminizing. Slurry blasting in the present example was performed at the aluminizing line and prior to the reheat furnace. After hot-dip aluminizing, the steel strip was recoiled.

Figure 3:
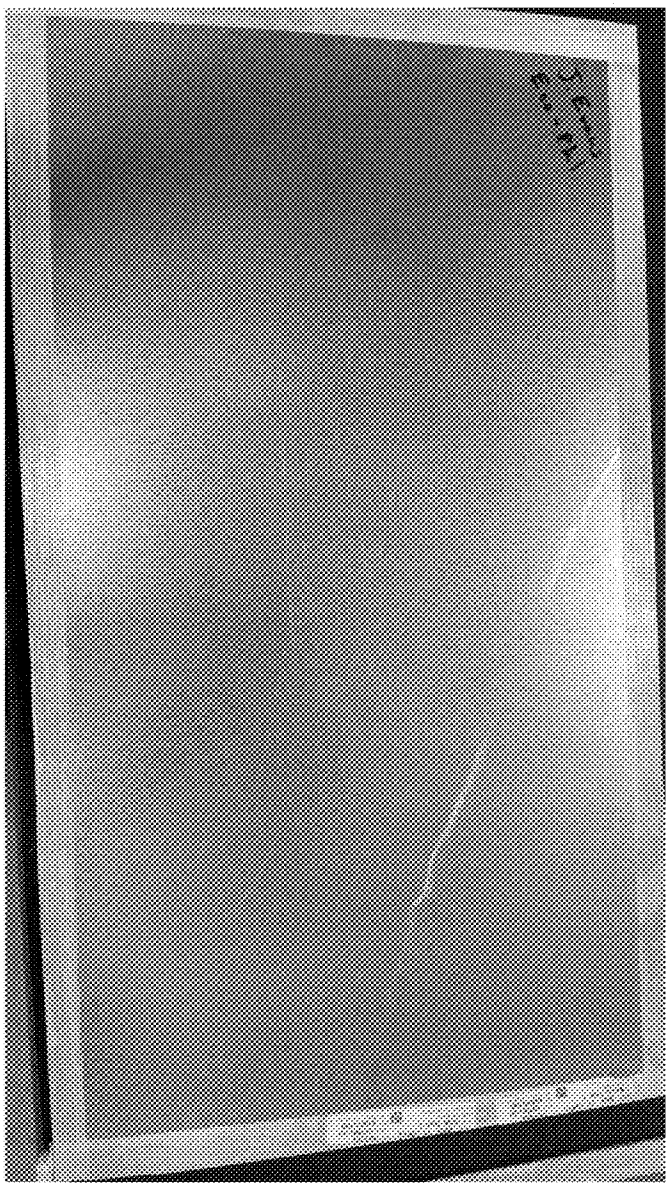
FIG. 3. depicts the surface appearance of an aluminized coating on a third sample, the third sample subjected to slurry blasting prior to aluminizing.
Figure 4:
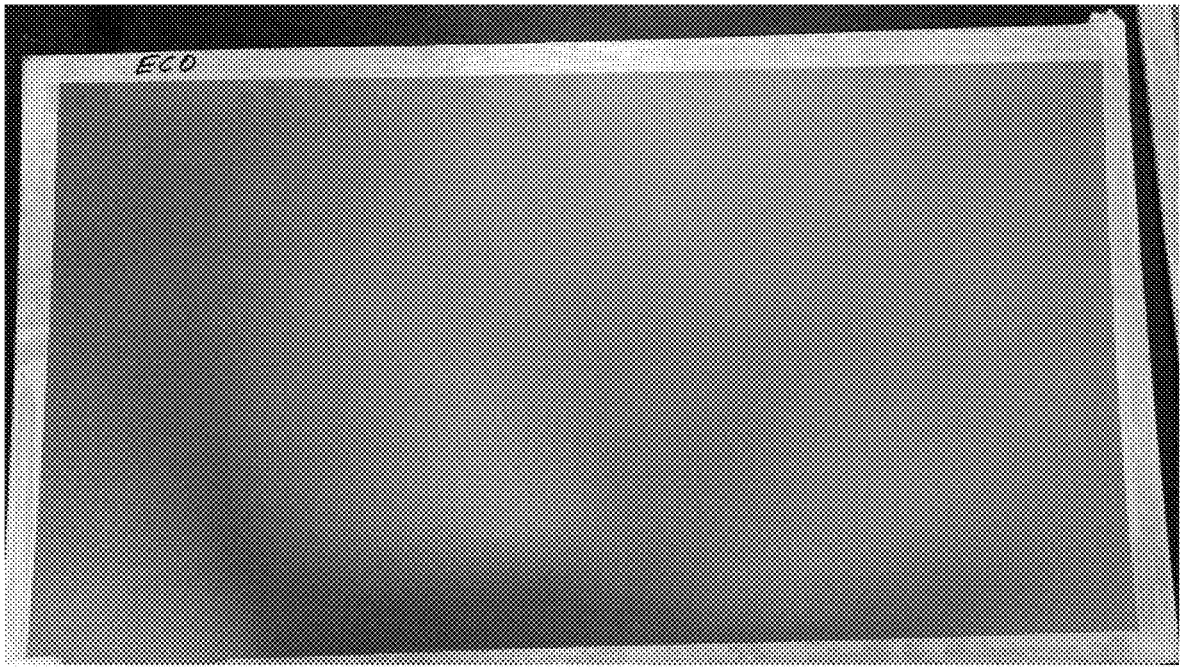
FIG. 4 depicts the surface appearance of an aluminized coating on a fourth sample, the fourth sample subjected to slurry blasting prior to aluminizing.

FIGS. 3 and 4 show the surface of the resulting aluminized coating after slurry blasting was used prior to aluminizing. Specifically, FIG. 3 shows a third sample where the surface of the aluminized coating is substantially uniform, particularly in comparison to the first and second samples shown in FIGS. 1 and 2, respectively. Similarly, FIG. 4 shows a fourth sample where the surface of the aluminized coating is also substantially uniform, particularly in comparison to the first and second samples shown in FIGS. 1 and 2, respective. It is therefore shown that the use of slurry blasting rather than pickling for descaling prior to hot-dip aluminizing results in substantially improved uniformity in coating appearance. The magnitude of the improved surface appearance with slurry blasting rather than pickling was unexpected. Additionally, performance at removing or otherwise reducing heavy scale, such as scale encountered on coil extremities, was unexpectedly good.

Example 3

The steel strip coil of Example 2 described above was subjected to further testing. In particular, the coil was unrolled and samples were collected from the head-end of the coil (the fifth sample) and the tail-end of the coil (the sixth sample). The resulting samples were then subjected to a bending adherence test. The particular bending adherence test used included a bend radius that varied with substrate thickness.

Figure 5:
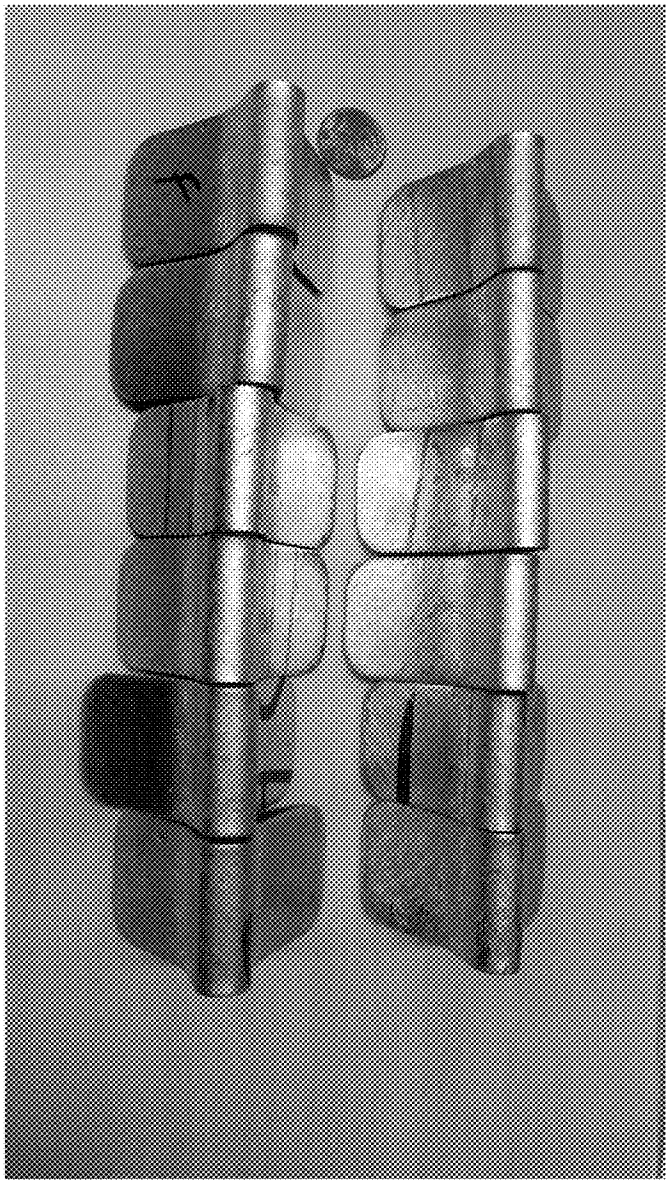
FIG. 5 depicts a fifth and sixth sample after performance of a bend adherence test for an aluminized coating thereon, the fifth and sixth samples being subjected to slurry blasting prior to aluminizing.

FIG. 5 shows the results of the bending adherence test. The fifth sample is shown in the top row and the sixth sample is shown in the bottom row. As can be seen, the slurry blasted steel strip of Example 2 exhibited acceptable adhesion at both the head-end and tail-end of the coil. It is therefore shown that the use of slurry blasting rather than pickling for descaling prior to hot-dip aluminizing results in acceptable adhesion performance of the aluminized coating.

Example 4

A coated steel was prepared according to the following process:

a. Hot rolling or cold rolling a steel ingot to form a steel strip;
b. Slurry blasting at least one side of the steel strip; and
c. After slurry blasting, coating the steel strip with an aluminum-based coating.

Example 5

A coated steel was prepared in accordance with the process of Example 4, the process further including coiling the steel strip, uncoiling the steel strip prior to the step of slurry blasting, and recoiling the steel strip prior to the step of coating the steel strip with the aluminum-based coating.

Example 6

A coated steel was prepared in accordance with the process of Example 5, wherein the step of slurry blasting was performed continuously with uncoiling and recoiling the steel strip.

Example 7

A coated steel was prepared in accordance with the process of Example 4, the process further including coiling the steel strip and transferring the coiled steel strip to an aluminizing line, the step of slurry blasting being performed at the aluminizing line as a part of a pre-cleaning process prior to coating the steel strip with the aluminum-based coating.

Example 8

A coated steel was prepared in accordance with the process of any one or more of Examples 4 through 7, the step of hot rolling or cold rolling the steel ingot including pickling the steel strip after hot rolling or cold rolling.

Example 9

A coated steel prepared in accordance with the process of any one or more of Examples 4 through 7, wherein the step of slurry blasting the steel strip includes adjusting a feed speed and pressure associated with the slurry blasting in real-time based on visual scale removal from the steel strip.

Example 10

A coated steel was prepared in accordance with the process of any one or more of Examples 4 through 9, wherein the aluminum-based coating includes a Type-1 or Type 2 aluminized coating.

Example 11

A coated steel was prepared in accordance with the process of any one or more of Examples 4 through 10, wherein the aluminum-based coating includes 5 to 11% silicon.

Example 12

A coated steel was prepared in accordance with the process of any one or more of Examples 4 through 11, wherein the step of slurry blasting the steel strip includes use of an abrasive medium, the abrasive medium including a mix of water and abrasive particles.

Example 13

A coated steel was prepared in accordance with the process of any one or more of Examples 4 through 12, wherein the step of slurry blasting the steel strip includes slurry blasting both sides of the steel strip.

Example 14

A coated steel was prepared using the following coating line system, the coating line system comprising: an aluminizing section including a hot-dip molten bath, the molten bath including molten aluminum; and a slurry blasting section, the slurry blasting section being configured to direct a high-velocity abrasive mixture towards one or more surfaces of a steel strip, the slurry blasting section being disposed operationally before the aluminizing section such that the slurry blasting section may be configured to act as a pre-cleaning process prior to subjecting the steel strip to aluminizing via the aluminizing section.

Example 15

A coated steel was prepared using the coating line system of Example 14, the coating line system further comprising a reheat furnace, the slurry blasting section being disposed operationally before the reheat furnace.

Example 16

A coated steel was prepared using the coating line system of Examples 14 or 15, the slurry blasting section including a feed speed control and a pressure control, the feed speed control and the pressure control both being configured to permit real-time adjustment to control removal of scale from the one or more surfaces of the steel strip.

Example 17

A coated steel was prepared using the coating line system of any one or more of Examples 14 through 16, the aluminizing section and the slurry blasting section being configured to operate with each other in a continuous operation.

Example 18

A coated steel was prepared using the coating line system of any one or more of Examples 14 through 17, the slurry blasting section being configured to remove scale from a first surface and a second surface of the steel strip.

What is claimed is:

1. A method for preparing a coated steel, the method comprising:

(a) hot rolling or cold rolling a steel ingot to form a steel strip;

(b) coiling the steel strip;

(c) uncoiling the steel strip;

(d) recoiling the steel strip;

(e) slurry blasting at least one side of the steel strip continuously with uncoiling and recoiling the steel strip; and (f) after the step of recoiling the steel strip, coating the steel strip with an aluminum-based coating, wherein the step of slurry blasting the steel strip includes adjusting a feed speed and pressure associated with the slurry blasting in real-time based on visual scale removal from the steel strip.

2. The method of claim 1, further comprising coiling the steel strip and transferring the coiled steel strip to an aluminizing line, the step of slurry blasting being performed at the aluminizing line as a part of a pre-cleaning process prior to coating the steel strip with the aluminum-based coating.

3. The method of claim 1, the step of hot rolling or cold rolling the steel ingot including pickling the steel strip after hot rolling or cold rolling.

4. The method of claim 1, wherein the aluminum-based coating includes a Type-1 or Type 2 aluminized coating.

5. The method of claim 1, wherein the aluminum-based coating includes 5 to 11 wt % silicon.

6. The method of claim 1, wherein the step of slurry blasting the steel strip includes use of an abrasive medium, the abrasive medium including a mix of water and abrasive particles.

7. The method of claim 1, wherein the step of slurry blasting the steel strip includes slurry blasting both sides of the steel strip.

* * * * *